US007900493B2

(12) United States Patent
Jiahua et al.

(10) Patent No.: US 7,900,493 B2
(45) Date of Patent: Mar. 8, 2011

(54) CLOSED FORGING DIE AND FORGING METHOD

(75) Inventors: Miao Jiahua, Shizuoka-ken (JP); Akira Sera, Shizuoka-ken (JP); Nobuo Suzuki, Shizuoka-ken (JP)

(73) Assignee: NTN Corporation, Osaka-fu (JP)

( * ) Notice: Subject to any disclaimer, the term of this patent is extended or adjusted under 35 U.S.C. 154(b) by 322 days.

(21) Appl. No.: 12/007,099

(22) Filed: Jan. 7, 2008

(65) Prior Publication Data

US 2008/0184765 A1 Aug. 7, 2008

(30) Foreign Application Priority Data

Feb. 2, 2007 (JP) ..... 2007-024346

(51) Int. Cl.
*B21D 22/00* (2006.01)

(52) U.S. Cl. ..... 72/353.2; 72/354.2; 72/354.6; 72/356

(58) Field of Classification Search ..... 72/353.2, 72/354.2, 355.2, 355.4, 355.6, 360, 407, 72/256, 340, 341, 356, 354.6
See application file for complete search history.

(56) References Cited

U.S. PATENT DOCUMENTS

| | | | | | |
|---|---|---|---|---|---|
| 3,680,381 | A * | 8/1972 | Portal | 72/355.6 |
| 4,074,559 | A * | 2/1978 | Beane et al. | 72/354.2 |
| 4,078,414 | A * | 3/1978 | Orain | 72/354.2 |
| 4,918,970 | A * | 4/1990 | Ishinaga | 72/355.6 |
| 4,936,133 | A * | 6/1990 | Orain | 72/340 |
| 5,174,147 | A * | 12/1992 | Bottger | 72/353.2 |
| 5,746,085 | A * | 5/1998 | Harada et al. | 72/355.6 |
| 6,044,684 | A * | 4/2000 | Ohama et al. | 72/354.2 |
| 6,427,326 | B1 * | 8/2002 | Soga et al. | 29/888.092 |
| 6,708,549 | B2 * | 3/2004 | Hainz et al. | 72/353.2 |
| 7,013,696 | B2 * | 3/2006 | Ando et al. | 72/355.6 |
| 7,219,524 | B2 * | 5/2007 | Miyashita et al. | 72/340 |
| 7,251,979 | B2 * | 8/2007 | Sakuragi et al. | 72/340 |
| 7,690,236 | B2 * | 4/2010 | Otaki | 72/355.6 |

FOREIGN PATENT DOCUMENTS

| | | | |
|---|---|---|---|
| JP | 61-193739 | * | 8/1986 |
| JP | 6-39477 | * | 2/1994 |
| JP | 2003-343592 | | 12/2003 |

* cited by examiner

*Primary Examiner* — Edward Tolan
(74) *Attorney, Agent, or Firm* — Wenderoth, Lind & Ponack, L.L.P.

(57) ABSTRACT

A closed forging die and a forging method with which sagging can be reduced, a constant velocity joint and a universal joint can be made compact and lightweight, removal of a shaft tip thereof by machining prior to heat treatment is not required, and material costs and machining costs can be reduced by using a closed forging die includes openable dies, and punches that move in an opening/closing direction of the dies to pressurize a material in the dies. By using the die, a product having shaft portions formed radially is manufactured. A clearance is provided to each of the formed shaft portions between a tip surface, and abutting portions are provided to the dies side abutting against at least a tip side of an outer circumferential surface of the shaft portions.

10 Claims, 6 Drawing Sheets

CLOSED FORGING DIE AND FORGING METHOD

BACKGROUND OF THE INVENTION

1. Field of the Invention

The present invention relates to a closed forging die and a forging method.

2. Description of the Related Art

In manufacturing a product having a boss portion radially provided with shaft portions, such as a trunnion for a constant velocity joint or a cross spider for a universal joint, by closed forging, a closed forging die is used.

As shown in FIG. 8, the closed forging die includes openable dies 1 and 2, and punches 4 and 5 arranged so as to be capable of being driven along center axes of the dies 1 and 2, respectively. That is, by pressurizing a material therein by the punches 4 and 5 while the dies 1 and 2 are in a closed state, a cavity 9 corresponding to configurations of shaft portions 7 and a boss portion 8 of a product 6 is molded. Thus, as shown in FIG. 9A, in a case where, after introducing a billet (material) 10 (refer to FIG. 9A) in the dies 1 and 2, clamping is performed and then the billet 10 is pressurized by the punches 4 and 5, the billet 10 plastically deforms, to thereby configure the product 6 including the boss portion 8 and the shaft portions 7 as shown in FIG. 9B.

That is, as shown in FIG. 9A, in a case where the cylindrical billet 10 having a radius of curvature R2 is introduced in the die and forged, the product 6 having the shaft portions 7 each of whose tip portion 7*a* has a radius of curvature R2' larger than the radius of curvature R2 can be molded.

Incidentally, in a case where a sealed state is established in the closed forging die, a processing load drastically increases, which leads to a fear in that the die may be damaged or short-lived. Thus, a related art describes that a length of each shaft molding portion is set larger than a required length of each shaft portion, to thereby provide a clearance to each shaft tip portion (JP 2003-343592 A).

In the related art die formed with the clearance portion in each shaft molding portion, when the billet is pressurized by the punches, the material is extruded to mold the shaft portions. At a tip surface of each shaft portion, a center portion of the extruded material readily flows and a peripheral portion thereof does not readily flow. Thus, as shown in FIG. 4, a shaft portion having a tip surface having a radius of curvature R1' smaller than a radius of curvature R1 of the tip surface of a normal shaft portion is molded. In this manner, in the conventional die formed with a clearance in each shaft molding portion, "sagging" occurs by which a circumferential surface side is retracted toward a base end portion side of the shaft portion in an axial direction thereof compared to the tip portion of the normal shaft portion.

Thus, in a case of securing the length of the shaft portion accurately molded using the die, the material is additionally required by an amount corresponding to the "sagging." Incidentally, the forged product molded by using the closed forging die is included in an inner joint member of a constant velocity joint or a universal joint. Thus, in order to make the constant velocity joint or the universal joint employing the product compact and lightweight, it is necessary to machine a tip of the shaft portion to be removed.

In addition, in order to extend a lifetime of the constant velocity joint or the universal joint including the product incorporated therein and to suppress vibration and noise in use, it is necessary that, after increasing strength and hardness of the product by heat treatment, the shaft-portion outer circumferential surface of the product be molded higher in accuracy than that molded by the forging. Thus, it is necessary to finish the product by machining after the heat treatment. The shaft tip may be removed by the machining prior to the heat treatment in order to facilitate the machining after the heat treatment, and a coupling surface of the removed surface and the shaft-portion outer circumferential surface may be used as a reference for phase matching in the case where the shaft-portion outer circumferential surface is subjected to highly-accurate machining. Thus, the coupling portion is required to be formed with high accuracy.

SUMMARY OF THE INVENTION

In view of the above problems, it is an object of the present invention to provide a closed forging die and a forging method with which sagging can be reduced, which can make a constant velocity joint or a universal joint compact and lightweight, which do not require a shaft tip to be removed by machining prior to heat treatment, and which can reduce material costs and machining costs.

According to the present invention, there is provided a closed forging die for molding a product having shaft portions radially formed, the closed forging die including: dies which are openable; and punches, which move in an opening/closing direction of the dies to pressurize a material in the dies, in which: a clearance is provided to a tip surface of each of the shaft portions molded; and the dies are each provided with abutting portions abutting against at least a tip side of an outer circumferential surface of each of the shaft portions.

According to the closed forging die of the present invention, during the pressurization by the punch, the material abuts against the abutting portions, so the partial or entire configuration of the outer circumference of each shaft tip is secured by the dies. The portion thus secured can be used as a referential surface for phase matching in a case where the shaft-portion outer circumferential surface is subjected to highly-accurate machining.

According to the present invention, there is provided a forging method of molding a product having shaft portions radially formed, by using a closed forging die including dies which are openable and punches, which move in an opening/closing direction of the dies to pressurize a material in the dies, the forging method including molding the material to be introduced in the closed forging die such that a radius of curvature of a surface of the material, which is to be molded into a tip surface of each of the shaft portions, is larger than a radius of curvature of the tip surface of each of the shaft portions to be molded.

According to the forging method of the present invention, in the material to be introduced in the closed forging die, the radius of curvature of the surface, which is to be molded into the tip surface of each of the shaft portions, is larger than the radius of curvature of the tip surface of each of the shaft portions to be molded. Thus, in the process of molding the product configuration using the closed forging die (referred to as principal molding), even when the peripheral portion of the tip surface of the shaft portion less easily flows than the center portion thereof, "sagging" (an amount by which a circumferential surface side is retracted toward a base end portion side of the shaft portion in an axial direction thereof) can be reduced. In other words, prior to the principal molding, there is performed a preliminary molding process of molding the material such that the radius of curvature of the portion to be molded into the tip surface of each of the shaft portions is larger than the radius of curvature of the tip surface of each of the shaft portions to be molded. In the case of molding by using the closed forging die a product from the material which has been subjected to the preliminary molding process, even though a clearance is formed in the closed forging die, the "sagging" in the shaft portion can be reduced.

In the closed forging die according to the present invention, since the portion secured by the dies can be used as a referential surface for phase matching in the case of the highly-accurate machining, the shaft tip is not necessarily to be removed by machining in order to form a referential surface (referential portion) prior to heat treatment, to thereby reduce material costs and machining costs.

According to the present invention, the "sagging" can be reduced in the shaft portion, and thus a constant velocity joint or a universal joint employing the forged product can be made compact and lightweight.

BRIEF DESCRIPTION OF THE DRAWINGS

In the accompanying drawings:

FIG. 2 is a cross-sectional view showing the closed forging die viewed from a direction other than a direction from which FIG. 1 is viewed;

DETAILED DESCRIPTION OF THE PREFERRED EMBODIMENT

Hereinafter, an embodiment of the present invention will be described with reference to FIGS. 1 to 7.

Figure 1:
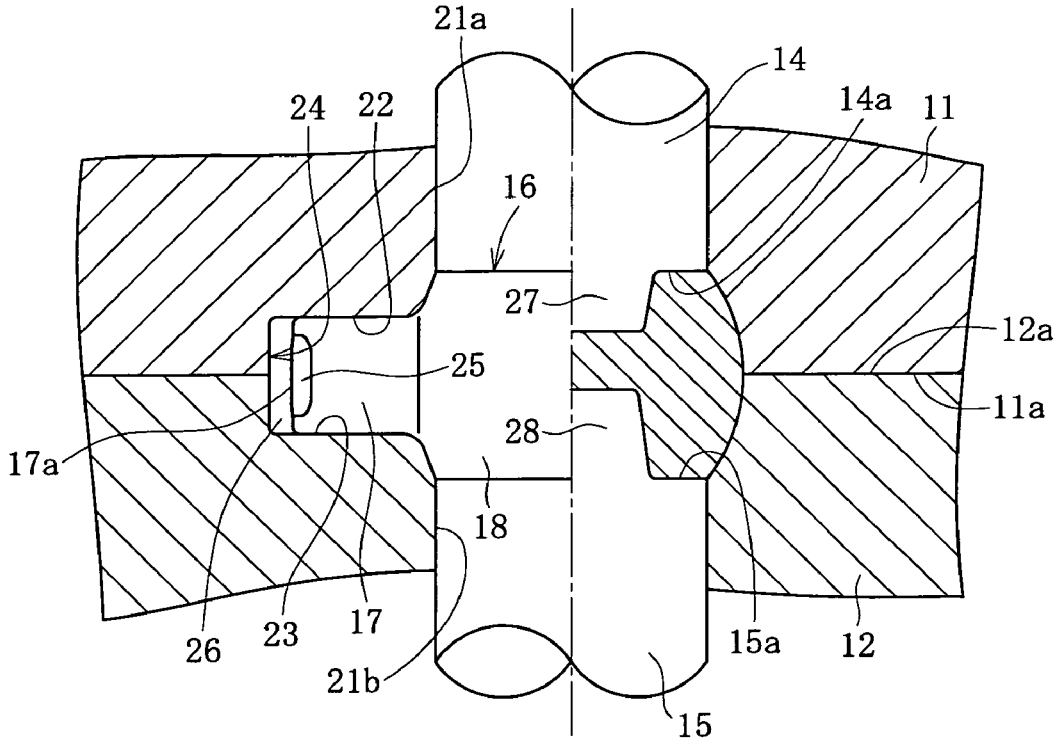
FIG. 1 is a cross-sectional view showing a closed forging die according to an embodiment of the present invention.

FIG. 1 shows a closed forging die according to an embodiment of the present invention. The closed forging die includes openable dies 11 and 12 and punches 14 and 15 which is driving along an opening/closing direction of the dies 11 and 12 to pressurize a material in the dies 11 and 12, respectively, and molds a product (e.g., trunnion for a constant velocity universal joint) 16 which is radially formed with shaft portions 17. Note that the product 16 being the trunnion includes a boss portion 18 and three shaft portions 17 externally extending from the boss portion 18 in a diameter direction thereof.

Accordingly, the dies 11 and 12 are provided with guide holes 21*a* and 21*b* at axial center portions thereof, respectively. In the guide holes 21*a* and 21*b*, the punches 14 and 15 are fit-inserted, respectively. Further, in opening portions of the guide holes 21*a* and 21*b* on contact surfaces 11*a* and 12*a* side of the dies 11 and 12, three concave portions 22 and three concave portions 23 extending in the diameter direction of the guide holes 21*a* and 21*b* are arranged at pitches of 120°, respectively.

In a state where the dies 11 and 12 are superimposed with each other as shown in FIG. 1, voids 24 for forming the shaft portions 17 of the product 16 are formed by the opposing concave portions 22 and 23. In this case, in each void 24, abutting portions 25 are provided in the outer side of the diameter direction so as to swell toward the inside of the void 24, and the abutting portions 25 abut on the molded shaft portion 17 at a tip portion side of an outer circumferential surface of the shaft portion 17. In addition, a gap (clearance) 26 is formed at a tip portion 17*a* of the shaft portion 17 to be molded.

Further, on a lower surface 14*a* of the upper punch 14, a swelling portion 27 is provided at a center portion thereof, and on a lower surface 15*a* of the lower punch 15, a swelling portion 28 is provided at a center portion thereof.

Figure 2:
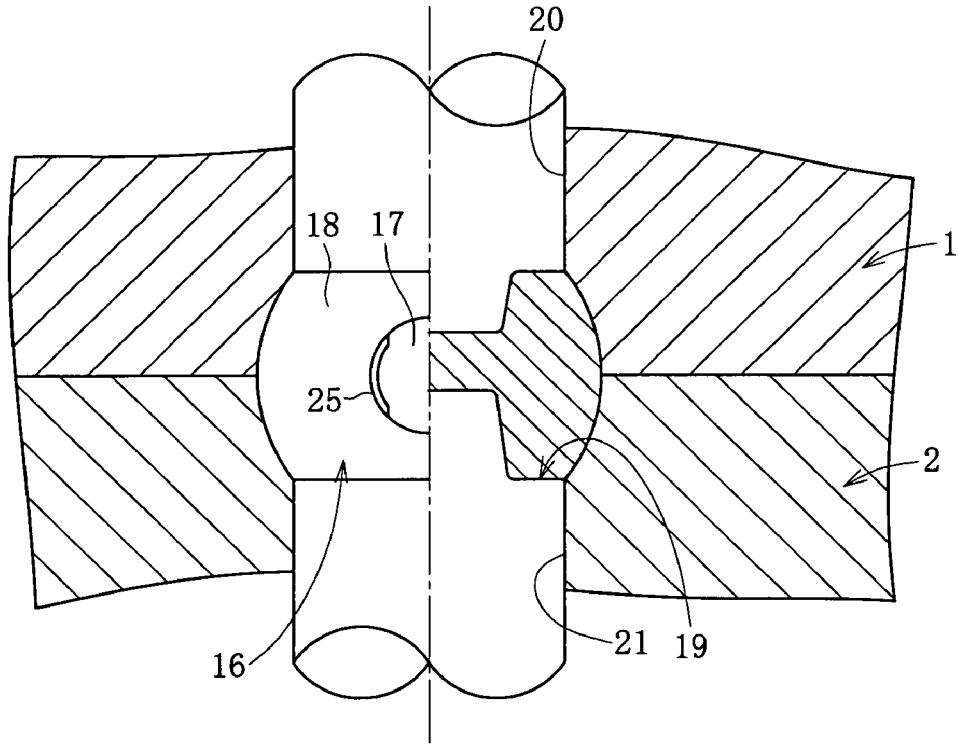
Figure 3:
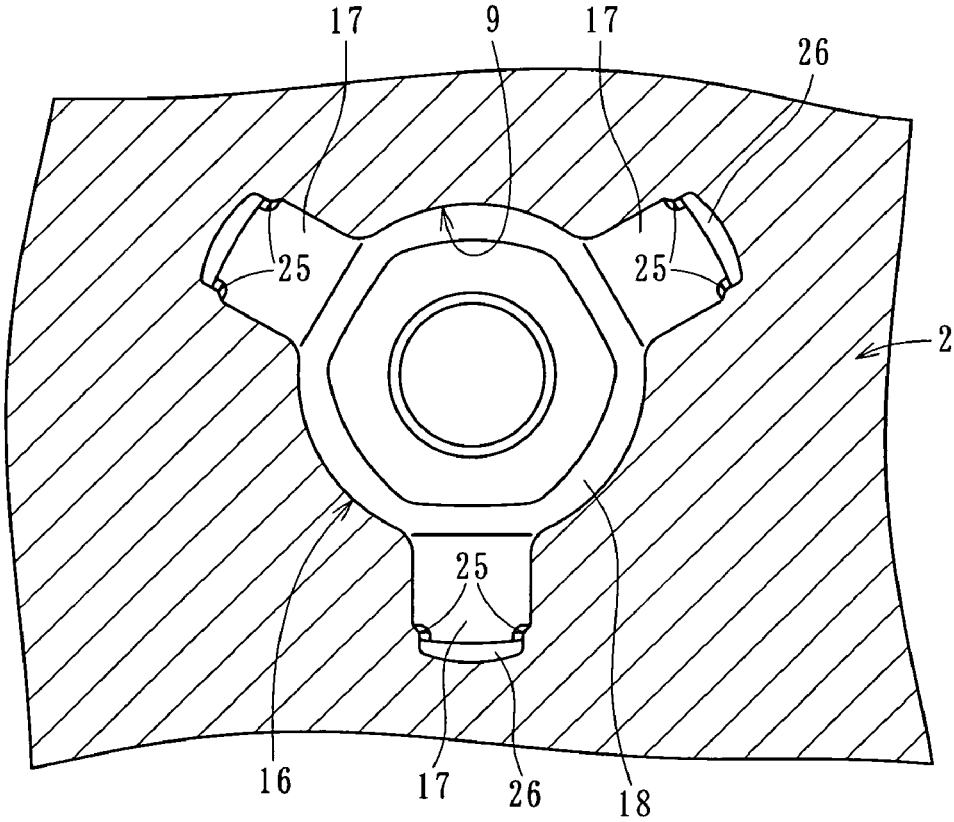
FIG. 3 is a cross-sectional plan view showing the closed forging die.

Next, a forging method using the die shown in FIGS. 1 to 3 will be described. First, the upper die 11 and the lower die 12 are relatively spaced apart from each other to establish a die-opened state. In this case, the upper punch 14 is raised and the lower punch 15 is lowered. In this state, in the guide hole 21*b* of the lower die 12, a billet (material) 20 (refer to FIG. 5) is introduced. Note that the billet 20 can be fit-inserted into the guide holes 21*a* and 21*b*, and corresponds to a volume of a product to be molded.

After that, clamping is performed so as to make the upper die 11 and the lower die 12 relatively close to each other. Next, the upper punch 14 is lowered and the lower punch 15 is raised. Thus, the billet 20 is vertically pressurized so that the voids 24 for forming the shaft portions 17 are formed. The billet 20 is caused to partially flow into the voids 24, to thereby mold the product 16 (tripod member) including the three shaft portions 17 radially extending from the circumference of the boss portion 18.

In this case, during the pressurization by the punches 14 and 15, the material abuts against the abutting portions 25, so the partial or entire configuration of the outer circumference of each shaft tip is secured by the dies. Secured portions 40 (refer to FIG. 4 etc.) thus formed can serve as referential surfaces (referential portions) for phase matching in a case where the outer circumferential surface of the shaft portion is subjected to highly-accurate machining. In addition, since the clearance 26 is formed at the tip surface 17*a* of the molded shaft portion 17, a surface pressure load with respect to the die can be reduced, to thereby prevent the die from being damaged.

Further, as shown in FIG. 7C, a material 20A has a configuration in which a radius of curvature R1 of each surface 30, which is to be molded into the tip surface 17*a* (refer to FIG. 4) of the shaft portion 17, is made larger than a radius of curvature R1' (refer to FIG. 4) of the tip surface 17*a* of the shaft portion 17 to be molded.

Figure 5:
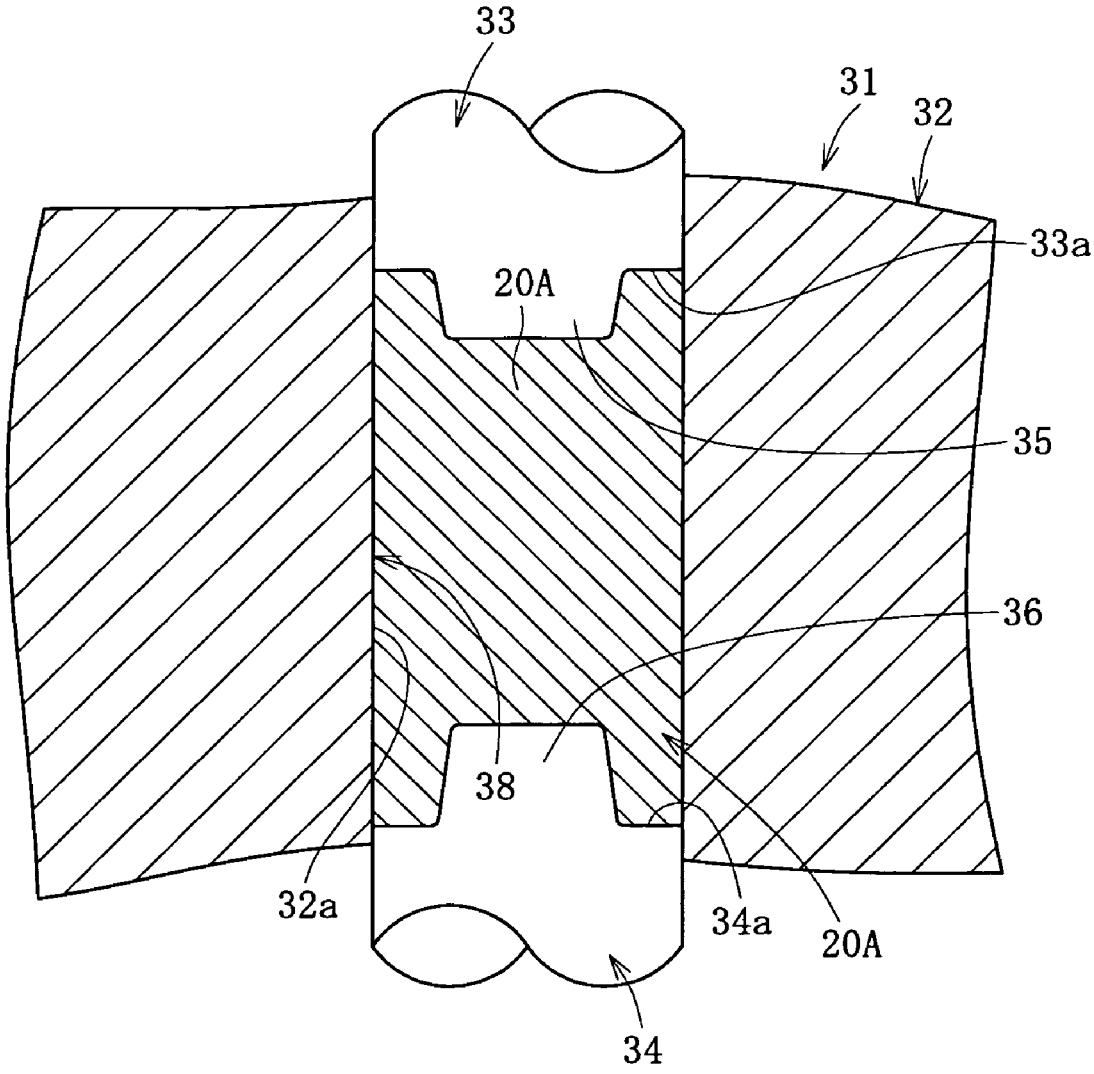
FIG. 5 is a cross-sectional view showing a mold apparatus used in preliminary molding.
Figure 6:
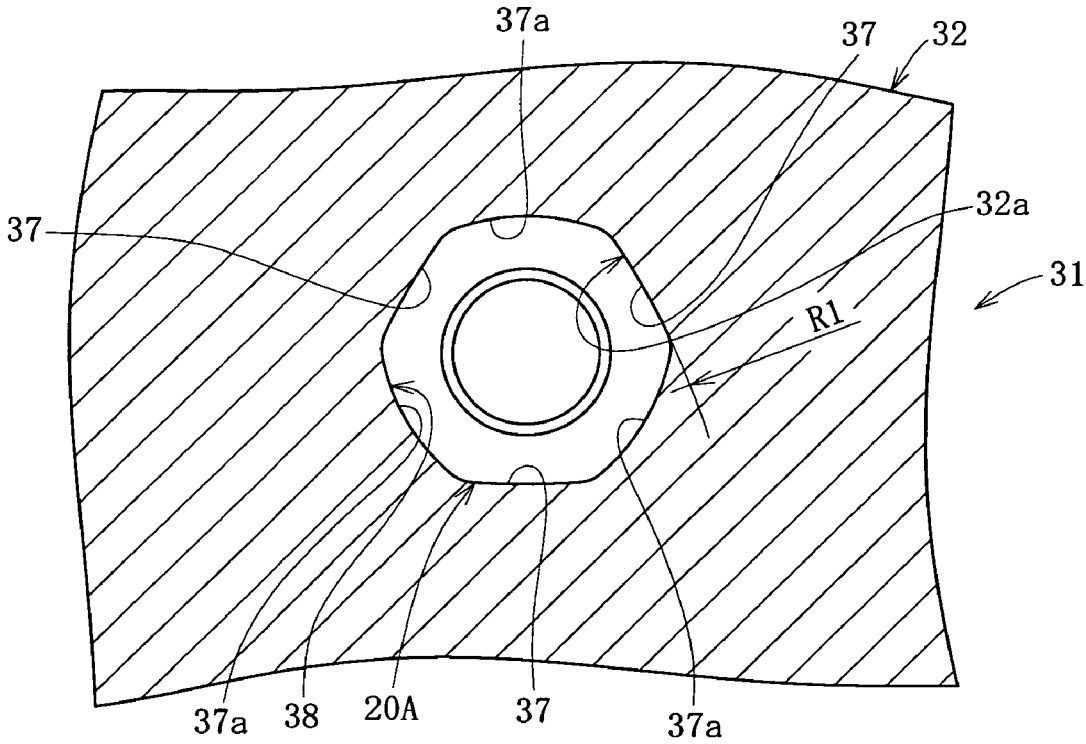
FIG. 6 is a cross-sectional plan view showing the mold apparatus.
Figure 7:
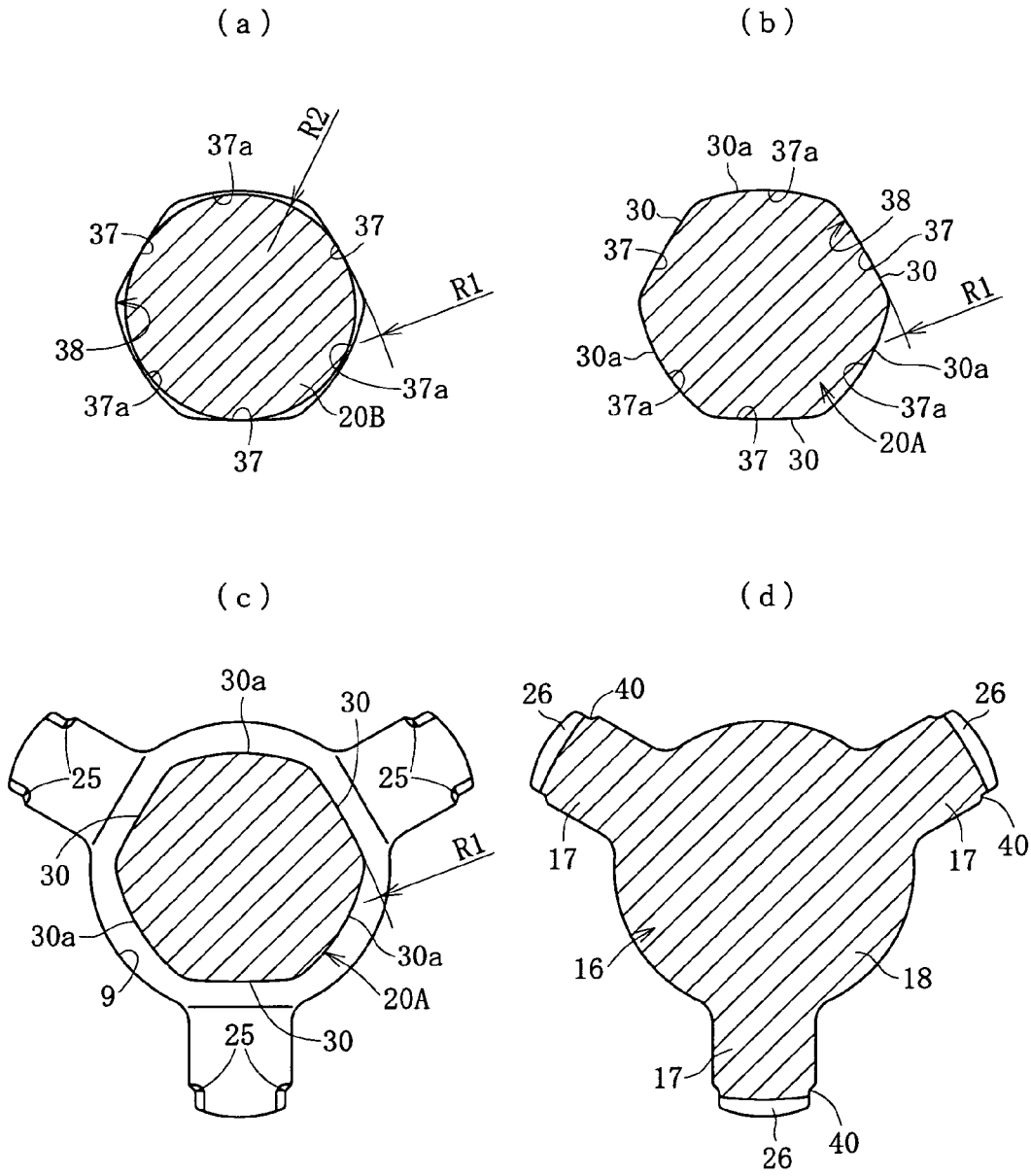
FIGS. 7A to 7D are diagrams for explaining processes of the preliminary molding.
Figure 8:
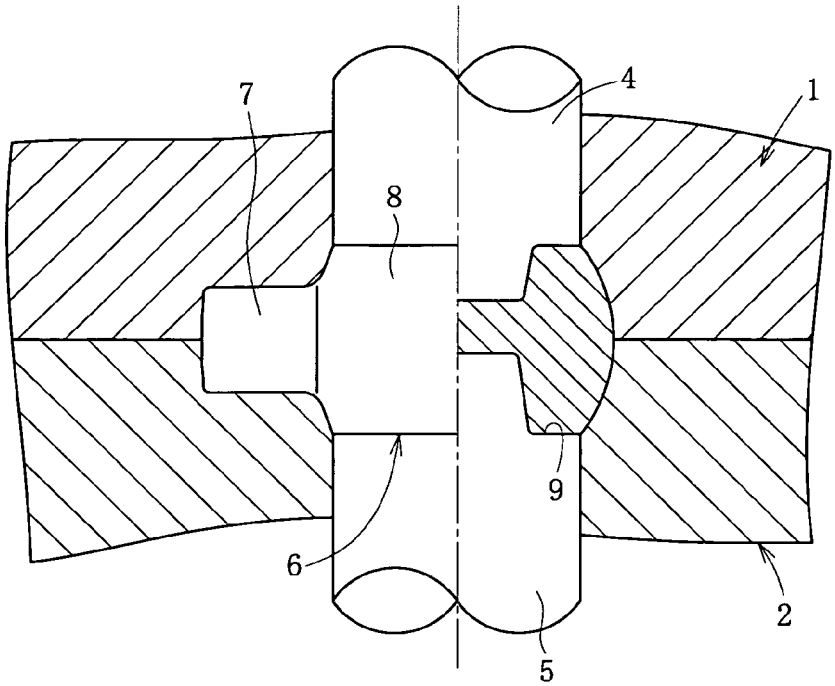
FIG. 8 is a cross-sectional view showing a conventional closed forging die.

The material 20A is manufactured by using a mold apparatus 31 shown in FIGS. 5 and 6. The mold apparatus 31 includes a preliminary molding die 32, and a preliminary molding punch 33 and an ejector 34 which are fit-inserted into a hole portion 32*a* of the preliminary molding die 32.

The hole portion 32*a* of the preliminary molding die 32 is a hexagonal hole whose cross-sectional configuration is as shown in FIG. 6. In this case, the hole portion 32*a* is formed with three surfaces 37 each having the radius of curvature R1 same as the radius of curvature R1 of each surface 30 of the material 20A. That is, the surfaces 37 having the radius of curvature R1 are provided at pitches of 120°, and surfaces 37*a* each having a radius of curvature smaller than the radius of curvature R1 of each surface 37 are provided between the adjacent surfaces 37.

Further, a swelling portion 35 is formed at a center portion of a lower surface 33*a* of the preliminary molding punch 33, and a swelling portion 36 is formed at a center portion of an upper surface 34*a* of the ejector 34. The swelling portion 35 of the preliminary molding punch 33 has the same diameter and configuration as those of the swelling portion 27 of the upper punch 14, and the swelling portion 36 at the center portion of the upper surface 34*a* of the ejector 34 has the same diameter and configuration as those of the swelling portion 28 of the lower punch 15. Note that a reinforcing member (reinforcing ring; not shown) is externally fitted in the preliminary molding die 32 by press fitting or shrink fitting.

Subsequently, a molding method of the material 20A by using the mold apparatus 31 will be described. First, as shown in FIG. 7A, a disk-like billet 20B having a radius of curvature R2 of outer-circumferential-surface is introduced in the mold apparatus 31 in a opened state. In this case, the opened state refers to a state where the preliminary molding punch 33 is raised, which allows the billet 20B to be introduced in the hole portion 32*a* of the preliminary molding die 32. Alternatively, although not shown in the drawings, an outer circumferential surface of the billet 20B may be subjected to ironing, to thereby eventually obtain the material 20A.

At this time, the radius of curvature R2 of outer-circumferential-surface of the billet 20B is set smaller than the radius of curvature R1 of each surface 37 of the hole portion 32*a*. Further, the billet 20B is inserted into the hole portion 32*a* while maintaining a gap of ϕ0.005 to ϕ0.3. Alternatively, in the case where the circumferential surface of the billet 20B is formed by ironing, there is provided a guide portion which allows the billet 20B to be inserted into the billet-introducing side of the preliminary molding die 32 while maintaining the above-mentioned gap.

In this state, the preliminary molding punch 33 is lowered, and the billet 20B is pressurized by the preliminary molding punch 33 and the ejector 34. As a result, the billet 20B plastically deforms so as to fill a cavity 38 defined by the hole portion 32*a* of the preliminary molding die 32, the preliminary molding punch 33, and the ejector 34, whereby the material 20A as shown in FIG. 7B is molded. That is, the material 20A having the three surfaces 30 each having the radius of curvature R1 can be molded. Note that the surfaces 30*a* each having the radius of curvature corresponding to that of each surface 37*a* of the mold apparatus 31 is molded between the adjacent surfaces 30 each having the radius of curvature R1.

After that, as shown in FIG. 7C, the material 20A is introduced in the closed forging die. Subsequently, as described above, the dies 11 and 12 are subjected to clamping, and then the material 20A is pressurized by the punches 14 and 15. As a result, as shown in FIG. 7D, a product in which the boss portion 18 protrudingly provided with the shaft portions 17 can be molded. At this time, the three surfaces 30 of the material 20A are extruded into the voids (cavities) 24, to thereby mold the tip surfaces 17*a* of the shaft portions 17.

Figure 4:
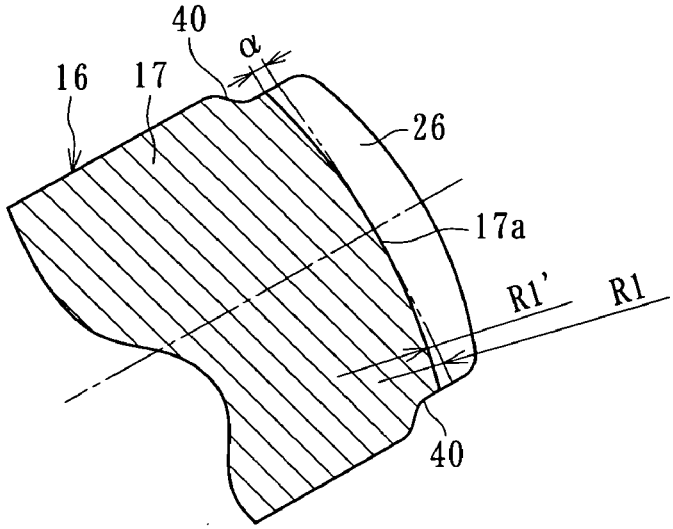
FIG. 4 is an enlarged cross-sectional view showing a main portion of a product molded by using the closed forging die.

As described above, in the case of using the mold apparatus 31, prior to the process of molding the product configuration (referred to as principal molding), there is performed a preliminary molding process of molding the material 20A having the radius of curvature R1 of each portion to be molded into the tip surface 17*a* of the shaft portion 17 in the principal molding larger than the radius of curvature of the tip surface 17*a* of the shaft portion 17 to be molded. In the principal molding, the peripheral portion of the portion to be molded into the tip surface 17*a* of the shaft portion 17 less easily flows than the center portion thereof. However, owing to the provision of the preliminary molding process, as shown in FIG. 4, "sagging" can be reduced even though the clearances 26 are provided in the closed forging die. In other words, each surface 30 of the billet 20B has the radius of curvature R1 while the tip surface 17*a* of the molded shaft portion 17 has the radius of curvature R1', i.e., the "sagging" is reduced. The reduction of the "sagging" of the tip portion 17*a* of each shaft portion 17 allows a constant velocity joint or a universal joint employing the forging product to be made compact and lightweight.

The embodiment of the present invention has been described in the above. However, the present invention is not limited to the embodiment but can be diversely modified. For example, each abutting portion 25 may be formed over the entire circumference of the void 24, while in the closed forging die according to the embodiment, the plurality of abutting portions 25 are arranged at predetermined pitches in the circumferential direction. In addition, the sectional configuration and the size of the abutting portions 25 can be arbitrarily changed as long as the outer circumferential configuration of each shaft tip is secured by the dies 11 and 12, and as long as each secured portion 40 thus molded can serve as the referential surface in the highly-accurate machining.

Further, in the closed forging die shown in FIG. 1, the configuration of the swelling portion 27 of the upper punch 14 is different from that of the swelling portion 28 of the upper punch 15, but they may be the same with each other. Also in this case, in the mold apparatus 31 shown in FIGS. 5 and 6, the configurations of the swelling portions 35 and 36 of the preliminary molding punch 33 and the ejector 34 are required to be the same as those of the swelling portions 27 and 28 of the upper and lower punches 14 and 15 shown in FIG. 1, respectively.

Further, in the case of performing the preliminary molding process as shown in FIGS. 7A to 7D, the closed forging die may not be provided with the abutting portions 25, since the preliminary molding process enables reducing the "sagging" in the tip portions 17*a* of the shaft portions 17, to thereby make a constant velocity joint or the like compact and lightweight. Note that the surface 30*a* may have the radius of curvature R1, while in the material 20A of the embodiment, the three surfaces 30 each having the radius of curvature R1 are arranged at pitches of 120° in the circumferential direction, and the radius of curvature of each surface 30*a* between the adjacent surfaces 30 has the radius of curvature different from the radius of curvature R1. In other words, all the six surfaces may each have the radius of curvature R1. In the case where every surface has the radius of curvature R1 as described above, positioning of the material 20A with respect to the closed forging die is readily performed when introducing the material 20A in the closed forging die, which is advantageous.

Example

Figure 9:
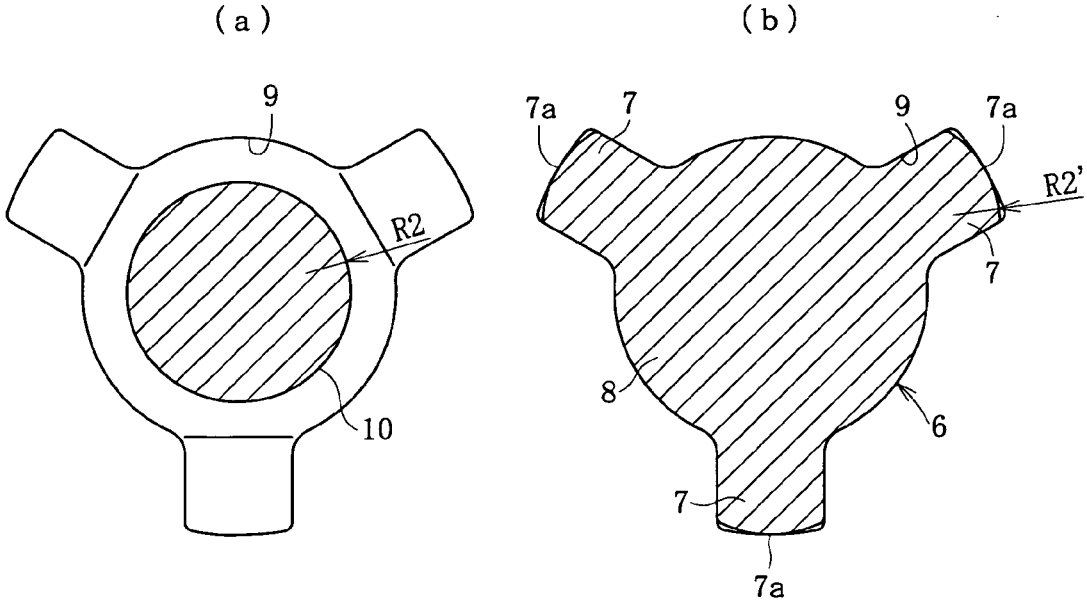
FIGS. 9A and 9B are diagrams for explaining conventional forging method.

A state of "sagging" in the case of performing the preliminary molding as shown in FIGS. 7A to 7D was compared to a state of "sagging" in a case of not performing the preliminary molding. Table 1 shows the result. In Table 1, "billet radius of curvature R2" represents the radius of curvature of the material 20B before the preliminary molding (i.e., radius of curvature of conventional material 10 shown in FIG. 9), "premolding radius of curvature R1" represents the radius of curvature of the preliminary-molded material 20A, "shaft end radius of curvature R3" represents the radius of curvature of the tip surface of the molded shaft portion 17, and "sagging" represents a difference between an outermost apex of the tip surface of the molded shaft portion 17 and an outer circumferential rim thereof

TABLE 1

| | Premolding performed | Premolding not performed |
|---|---|---|
| Billet radius of curvature R2 | 16.0 | 16.0 |
| Premolding radius of curvature R1 | 47.8 | — |
| Shaft end radius of curvature R3 | 30.5 | 22.1 |
| Sagging | 1.4 | 2.1 |

As apparent from Table 1, in the case of inserting and processing the material 20A in the principal-molding die without performing the premolding, the amount of sagging was 2.1 mm, while in the case of performing processing in the principal-molding die after performing the premolding, the amount of sagging was 1.4 mm, i.e., the sagging was reduced.

What is claimed is:

1. A forging method for molding a product having radially extending shaft portions, the method comprising:

providing a closed forging die which includes dies which are openable and punches which move in an opening/closing direction of the dies to pressurize a material in the dies; and forging the product using the closed forging die by pressurizing the material in the closed forging die using the punches such that radially extending shaft portions are formed and a clearance is provided between a sidewall of said dies and a tip surface of each of the shaft portions when forming of the shaft portions is complete, wherein abutting portions provided in the dies abut against only a portion of an outer circumference of the tip surface of each of the shaft portions such that indentations are formed in the portion of the outer circumference of the tip surface of the shaft portions.

2. A forging method according to claim 1, wherein the abutting portions are arranged at predetermined pitches in an outer circumferential direction of each of the shaft portions.

3. A forging method according to claim 1, wherein said dies form a cavity for molding the product, and wherein said cavity includes a boss portion cavity and three shaft portion cavities extending from the boss portion cavity in radial directions thereof such that the product is formed as a tripod member having three shaft portions.

4. A forging method according to claim 1, wherein said dies form a cavity for molding the product, wherein said cavity includes a boss portion cavity and three shaft portion cavities extending from the boss portion cavity in radial directions thereof such that the product is formed with three shaft portions, and wherein each of the shaft portion cavities has at least one of the abutting portions disposed at a distal end thereof, the abutting portions being arranged such that the tip surface of each of the shaft portions of the product has at least one of the indentations for use as a referential surface.

5. A forging method according to claim 1, wherein said dies form a cavity for molding the product, wherein said cavity includes a boss portion cavity and three shaft portion cavities extending from the boss portion cavity in radial directions thereof such that the product is formed with three shaft portions, wherein each of the shaft portion cavities has at least one of the abutting portions disposed at a distal end thereof, the abutting portions being arranged such that the tip surface of each of the shaft portions of the product has at least one of the indentations for use as a referential surface, and wherein the abutting portions are configured such that the indentations in the shaft portions extend over only a portion of the tip surface.

6. A forging method of molding a product having radially extending shaft portions by using a closed forging die including dies which are openable and punches which move in an opening/closing direction of the dies to pressurize a material in the dies, the forging method comprising:

molding the material to be introduced in the closed forging die into a shape having a polygonal cross section such that a radius of curvature of surfaces of the material between corners of the polygonal cross section is larger than a radius of curvature of the tip surface of each of the shaft portions to be molded; and after said molding operation, forging the product using the closed forging die by pressurizing the material in the closed forging die using the punches such that the surfaces between corners of the polygonal cross section are extruded into shaft portion cavities of the dies and form the shaft portions of the product, wherein the radius of curvature of the tip surface of each of the shaft portions extends in a cross section orthogonal to the opening/closing direction of the dies.

7. A forging method according to claim 6, wherein said forging operation provides a clearance between the tip surface of each of the shaft portions and the closed forging die when forming of the shaft portions is complete.

8. A forging method according to claim 6, wherein the radius of curvature of the surface of the material extends in a cross section orthogonal to the opening/closing direction of the dies.

9. A forging method of molding a product having radially extending shaft portions by using a closed forging die including dies which are openable and punches which move in an opening/closing direction of the dies to pressurize a material in the dies, the forging method comprising:

forging the product using the closed forging die by pressurizing a material having a shape with a polygonal cross section in the closed forging die using the punches, wherein an indentation is formed in an outer circumference of a tip surface of each of the shaft portions by abutting portions of the closed forging die; and machining the outer circumference of the shaft portions of the product using the indentation formed in the tip surface of each of the shaft portions as a referential portion, wherein said forging operation provides a clearance between the tip surface of each of the shaft portions and the closed forging die when forming of the shaft portions is complete.

10. A forging method according to claim 9, further comprising:

before said forging operation, molding the material into the shape having the polygonal cross section such that a radius of curvature of surfaces of the material between corners of the polygonal cross section is larger than a radius of curvature of the tip surface of each of the shaft portions to be molded; and before said forging operation, aligning the molded material in the closed forging die such that the surfaces of the material between the corners correspond to shaft portion cavities of the closed forging die, wherein said forging operation is performed such that the surfaces of the material between the corners are extruded into shaft portion cavities of the dies and form the shaft portions of the product, and wherein the radius of curvature of the tip surface of each of the shaft portions extends in a cross section orthogonal to the opening/closing direction of the dies.

* * * * *